US009061750B2

(12) United States Patent
Jones et al.

(10) Patent No.: US 9,061,750 B2
(45) Date of Patent: Jun. 23, 2015

(54) WATERCRAFT PROPULSION SYSTEM

(71) Applicants: Bartley D. Jones, Mound, MN (US); Steven R. Hendrickson, Burnsville, MN (US)

(72) Inventors: Bartley D. Jones, Mound, MN (US); Steven R. Hendrickson, Burnsville, MN (US)

( * ) Notice: Subject to any disclaimer, the term of this patent is extended or adjusted under 35 U.S.C. 154(b) by 0 days.

(21) Appl. No.: 14/159,826

(22) Filed: Jan. 21, 2014

(65) Prior Publication Data

US 2014/0206246 A1 Jul. 24, 2014

Related U.S. Application Data

(60) Provisional application No. 61/754,572, filed on Jan. 19, 2013.

(51) Int. Cl.
*B63H 5/07* (2006.01)
*B63H 21/17* (2006.01)

(52) U.S. Cl.
CPC . *B63H 5/07* (2013.01); *B63H 21/17* (2013.01)

(58) Field of Classification Search
CPC ..... B63H 5/07; B63H 21/17; B63H 23/06; B63H 7/087
USPC ..... 440/6, 53, 75, 83
See application file for complete search history.

(56) References Cited

U.S. PATENT DOCUMENTS 4,073,258 A 2/1978 Logan
4,443,202 A 4/1984 Arena
4,694,645 A 9/1987 Flyborg et al.
5,014,639 A 5/1991 Day
5,021,015 A 6/1991 Wang
5,213,527 A 5/1993 Fetchko
5,346,315 A 9/1994 Strong et al.
5,401,196 A 3/1995 Triantafyllou et al.
5,934,955 A 8/1999 Heston
6,022,249 A 2/2000 Ketterman
6,193,466 B1 2/2001 Earl
6,354,893 B1 3/2002 Sato
6,544,081 B1 4/2003 Paulo
6,675,730 B2 1/2004 Simard et al.
6,733,349 B2 5/2004 Chun
6,872,107 B1 3/2005 Paulo
6,887,115 B2 5/2005 Borgli
6,892,666 B1 5/2005 Plante et al.
6,997,765 B1 2/2006 McGuinness
7,115,007 B2 10/2006 Dulger
7,316,595 B2 1/2008 von Wolske
7,396,267 B1 7/2008 Parker
7,431,620 B1 10/2008 Harley
8,052,494 B1 11/2011 Whitten
8,187,044 B2 5/2012 Jemt
8,187,046 B2 5/2012 Rolla et al.
8,408,953 B2 4/2013 Bremsjo et al.
2002/0127926 A1 9/2002 Michel et al.
2003/0019411 A1 1/2003 Simard et al.
2003/0077956 A1 4/2003 Borgli
2004/0121665 A1 6/2004 Mizuguchi et al.
2005/0070180 A1 3/2005 von Wolske
2005/0250394 A1 11/2005 Nakamura et al.

(Continued)

*Primary Examiner* — Lars A Olson
(74) *Attorney, Agent, or Firm* — Mitchell A. Rossman; Terra Nova Patent Law, PLLC

(57) ABSTRACT

The present invention provides an electric-powered drive system for coupling to a hull of a watercraft. The electric-powered drive system includes one or more mounting units; a first support members, a second support member, a propeller shaft, a propeller coupled to the distal end of the propeller shaft; and a rudder.

20 Claims, 6 Drawing Sheets

(56) References Cited

U.S. PATENT DOCUMENTS

| | | | | |
|---|---|---|---|---|
| 2009/0191772 | A1 | 7/2009 | Wu | |
| 2010/0323565 | A1 | 12/2010 | Bernogger et al. | |
| 2012/0100764 | A1 | 4/2012 | Wingate et al. | |
| 2012/0282827 | A1 | 11/2012 | Jauncey | |
| 2013/0157527 | A1* | 6/2013 | Raynes | 440/6 |
| 2013/0189884 | A1 | 7/2013 | Jones et al. | |
| 2013/0260622 | A1 | 10/2013 | Kjellman et al. | |

* cited by examiner

WATERCRAFT PROPULSION SYSTEM

RELATED APPLICATIONS

This application claims priority to U.S. Provisional Patent Application Ser. No. 61/754,572 filed Jan. 19, 2013, which is hereby incorporated by reference in its entirety for all purposes.

BACKGROUND OF THE INVENTION

Boats powered by an inboard style propulsion system typically feature a multi-part driveline consisting of: (1) a motor or engine with a driving shaft or power takeoff, (2) amounting apparatus for the motor or engine, (3) a propeller shaft coupled to the driving shaft of the motor/engine and passing through the bottom of the boat's hull, (4) a packing box or stuffing box, or shaft log and shaft seal, which fastened to the inside hull bottom and through which the propeller shaft exits the hull and enters the water (5) a strut and bearing assembly, which protrudes downward from the exterior hull bottom and through which the propeller shaft passes such that the strut and bearing provide support and rigidity to the shaft beneath the hull, (6) a propeller, which is mechanically fastened to the end of the propeller shaft, and (7) a rudder, which extends below the hull bottom to direct the forces of the propeller, but which has a vertical stem that passes up, through and into the hull inside of a rudder bearing tube which is attached to the boat's hull bottom. Collectively, these seven components (motor, motor mount, shaft, shaft log, strut, propeller, and rudder) integrate to transmit and direct the motive forces of the inboard power plant. The effectiveness of such an inboard drive line is sensitive to the accurate alignment of the components relative to one another.

In traditional inboard drive line configurations, the installation of motor, motor mount, propeller shaft, and shaft log occur within the interior of the hull cavity, whereas the position and alignment of the strut, propeller, and rudder are set beneath the hull's exterior bottom. Because these interdependent installations occur on opposing sides of the hull's bottom, it can be very challenging to properly coordinate and align all components. Additional time and/or workers can be required to achieve a proper alignment of all components. An improper or imprecise alignment can cause problems such as friction or vibration during operation. The process is further complicated because the surface topology of a hull's interior may be inconsistent or irregular due to inexactness in fiberglass laminations or other construction methods used to fabricate the hull.

What is needed is a single, uniform mounting plate structure, shared by all the driveline components, and which a single technician can easily reach above and below when pre-aligning the integration of driveline components.

SUMMARY OF THE INVENTION

The present invention provides an electric-powered drive system for coupling to a hull of a watercraft. The electric-powered drive system includes one or more mounting units; a first support members, a second support member, a propeller shaft, a propeller coupled to the distal end of the propeller shaft; and a rudder.

The electric-powered drive system provides the following advantages: (1) allows for pre-alignment, assembly, and testing of the drive line "on the workbench" prior to installation into the boat, (2) may be bonded, by mechanical and/or chemical means into the hull's interior bottom and positioned such that the shaft log would align with an oblong cutout in the hull's bottom, which would accommodate the plane of the propeller shaft when inserted through the hull bottom via the shaft log, and (3) it assures that the electric motor, the propeller shaft, and the rudders are all in alignment.

An alternative bonding scheme would add a second, opposing plate affixed to the exterior bottom of the hull, which would fasten through the hull's bottom and onto the interior mounting plate structure. The two plates would thus create a "sandwich" effect against the hull's bottom when fastened. The application of silicone or other sealant to the fastening points and both plate structures' perimeters will help ensure a watertight bond between the mounting plates and hull structure.

The electric-powered drive system may be mounted in a fixed manner to effect a permanent, single position, which is comparable to a traditional inboard drive line. Such a fixed mounting position may be suitable for mono hull type craft such as flat bottom boats, v-hulls, or others.

The present invention provides an electric-powered drive system for coupling to a hull of a watercraft. The electric-powered drive system includes: a first unit including: a first mounting member having a first surface, a second surface, a proximal end, a distal end, a first proximal aperture, and a second distal aperture; a first support member having a first surface, a second surface, a proximal end, a distal end, and an aperture, wherein the proximal end of the first support member is coupled with the proximal end of the first mounting member and extends away from the first surface of the first mounting member; a second unit including: a second mounting member having a first surface, a second surface, a proximal end, a distal end, a first proximal aperture, and a second distal aperture; a second support member having a proximal end and a distal end, wherein the proximal end of the second support member is coupled to the second surface of the second mounting member, wherein the distal end of the second support member includes a cylindrical cavity having a proximal end and a distal end; a propeller shaft having a proximal end and a distal end, wherein the propeller shaft is coupled through the cylindrical cavity so that the distal end of the propeller shaft extends through and beyond the distal end of the cylindrical cavity and the proximal end of the propeller shaft extends through the first proximal aperture of the second mounting member, the first proximal aperture of the first mounting member, and is operatively coupled with an electric motor mounted on the first surface of the first support member through the aperture of the first support member; a propeller coupled to the distal end of the propeller shaft; and a rudder having a proximal end, a distal end, and a rudder shaft extending perpendicular to a vertical plane of the rudder, wherein the rudder shaft is coupled through the second distal aperture of the second mounting member and the second distal aperture of the first mounting member.

In one embodiment, the electric motor is operatively coupled to an electric power source. In one embodiment, the rudder shaft is operatively coupled to a helm. In one embodiment, the electric-powered drive system further includes a rudder bearing tube coupled to the first surface of the first mounting member.

In one embodiment, the electric-powered drive system further includes a shaft log containing a shaft seal coupled to the first proximal aperture and the second distal aperture. In one embodiment, the electric-powered drive system further includes a coupling between the proximal end of the propeller shaft and an electric motor shaft extending from the electric motor. In one embodiment, the electric-powered drive system further includes a first vertical flange and a second vertical flange each independently coupled to the first surface of the first mounting member. In one embodiment, the first vertical flange, the second vertical flange, and the proximal end of the second support member are secured by one or more bolts The present invention provides an electric-powered drive system for coupling to a hull of a watercraft. The electric-powered drive system includes: a first unit including: a first mounting member having a first surface, a second surface, a proximal end, a distal end, a first proximal aperture, and a second distal aperture; a first support member having a first surface, a second surface, a proximal end, a distal end, and an aperture, wherein the proximal end of the first support member is coupled with the proximal end of the first mounting member and extends away from the first surface of the first mounting member; a second unit including: a second mounting member having a first surface, a second surface, a proximal end, a distal end, a first proximal aperture, and a second distal aperture; a second support member having a proximal end and a distal end, wherein the proximal end of the second support member is coupled to the second surface of the second mounting member, wherein the distal end of the second support member includes a cylindrical cavity having a proximal end and a distal end; a propeller shaft having a proximal end and a distal end, wherein the propeller shaft is coupled through the cylindrical cavity so that the distal end of the propeller shaft extends through and beyond the distal end of the cylindrical cavity and the proximal end of the propeller shaft extends through the first proximal aperture of the second mounting member, the first proximal aperture of the first mounting member, and is operatively coupled with an electric motor mounted on the first surface of the first support member through the aperture of the first support member, wherein the electric motor is operatively coupled to an electric power source; a propeller coupled to the distal end of the propeller shaft; a shaft log containing a shaft seal coupled to the first proximal aperture and the second distal aperture; a rudder having a proximal end, a distal end, and a rudder shaft extending perpendicular to a vertical plane of the rudder, wherein the rudder shaft is coupled through the second distal aperture of the second mounting member and the second distal aperture of the first mounting member, wherein the rudder shaft is operatively coupled to a helm; and a coupling between the proximal end of the propeller shaft and an electric motor shaft extending from the electric motor.

In one embodiment, the electric-powered drive system further includes a first vertical flange and a second vertical flange each independently coupled to the first surface of the first mounting member. In one embodiment, the electric-powered drive system further includes a rudder bearing tube coupled to the first surface of the first mounting member. In one embodiment, the first vertical flange, the second vertical flange, and the proximal end of the second support member are secured by one or more bolts.

The present invention provides an electric-powered drive system for coupling to a hull of a watercraft. The electric-powered drive system includes: a unit including: a mounting member having a first surface, a second surface, a proximal end, a distal end, a first proximal aperture, and a second distal aperture, wherein the mounting member is coupled to an opening on a bottom of the hull of the watercraft; a first support member having a first surface, a second surface, a proximal end, a distal end, and an aperture, wherein the proximal end of the first support member is coupled with the proximal end of the mounting member and extends away from the first surface of the mounting member; and a second support member having a proximal end and a distal end, wherein the proximal end of the second support member is coupled to the first surface of the mounting member, wherein the distal end of the second support member includes a cylindrical cavity having a proximal end and a distal end; a propeller shaft having a proximal end and a distal end, wherein the propeller shaft is coupled through the cylindrical cavity so that the distal end of the propeller shaft extends through and beyond the distal end of the cylindrical cavity and the proximal end of the propeller shaft extends through the first proximal aperture of the mounting member and is operatively coupled with an electric motor mounted on the first surface of the first support member through the aperture of the first support member; a propeller coupled to the distal end of the propeller shaft; and a rudder having a proximal end, a distal end, and a rudder shaft extending perpendicular to a vertical plane of the rudder, wherein the rudder shaft is coupled through the second distal aperture of the mounting member.

In one embodiment, the electric motor is operatively coupled to an electric power source. In one embodiment, the rudder shaft is operatively coupled to a helm. In one embodiment, the electric-powered drive system further includes a rudder bearing tube coupled to the first surface of the mounting member. In one embodiment, the electric-powered drive system further includes a coupling between the proximal end of the propeller shaft and an electric motor shaft extending from the electric motor.

In one embodiment, the electric-powered drive system further includes one or more bonding flanges each independently coupled to the first surface, a second surface, or a combination thereof of the mounting member. In one embodiment, the one or more bonding flanges are each independently coupled to the first surface of the mounting member. In one embodiment, the electric-powered drive system further includes a shaft log containing a shaft seal coupled to the first proximal aperture.

In one embodiment, the electric-powered drive system further includes one or more vertical support members each independently coupled to the first surface, a second surface, or the first surface and the second surface of the mounting member. In one embodiment, the one or more vertical support members are each independently coupled to the first surface of the mounting member. In one embodiment, the electric-powered drive system further includes a first vertical flange and a second vertical flange each independently coupled to the first surface of the mounting member. In one embodiment, the first vertical flange, the second vertical flange, and the proximal end of the second support member are secured by one or more bolts.

The present invention provides an electric-powered drive system for coupling to a hull of a watercraft. The electric-powered drive system consists of: a first unit consisting of: a first mounting member having a first surface, a second surface, a proximal end, a distal end, a first proximal aperture, and a second distal aperture; a first support member having a first surface, a second surface, a proximal end, a distal end, and an aperture, wherein the proximal end of the first support member is coupled with the proximal end of the first mounting member and extends away from the first surface of the first mounting member; a second unit consisting of: a second mounting member having a first surface, a second surface, a proximal end, a distal end, a first proximal aperture, and a second distal aperture; a second support member having a proximal end and a distal end, wherein the proximal end of the second support member is coupled to the second surface of the second mounting member, wherein the distal end of the second support member consists of a cylindrical cavity having a proximal end and a distal end; a propeller shaft having a proximal end and a distal end, wherein the propeller shaft is coupled through the cylindrical cavity so that the distal end of the propeller shaft extends through and beyond the distal end of the cylindrical cavity and the proximal end of the propeller shaft extends through the first proximal aperture of the second mounting member, the first proximal aperture of the first mounting member, and is operatively coupled with an electric motor mounted on the first surface of the first support member through the aperture of the first support member, wherein the electric motor is operatively coupled to an electric power source; a propeller coupled to the distal end of the propeller shaft; a shaft log containing a shaft seal coupled to the first proximal aperture; a rudder having a proximal end, a distal end, and a rudder shaft extending perpendicular to a vertical plane of the rudder, wherein the rudder shaft is coupled through the second distal aperture of the second mounting member and the second distal aperture of the first mounting member, wherein the rudder shaft is operatively coupled to a helm; a rudder bearing tube coupled to the first surface of the first mounting member; a first vertical flange and a second vertical flange each independently coupled to the first surface of the first mounting member, wherein the first vertical flange, the second vertical flange, and the proximal end of the second support member are secured by one or more bolts; and a coupling between the proximal end of the propeller shaft and an electric motor shaft extending from the electric motor.

The present invention provides an electric-powered drive system for coupling to a hull of a watercraft. The electric-powered drive system consists of: a unit consisting of: a mounting member having a first surface, a second surface, a proximal end, a distal end, a first proximal aperture, and a second distal aperture, wherein the mounting member is coupled to an opening on a bottom of the hull of the watercraft; a first support member having a first surface, a second surface, a proximal end, a distal end, and an aperture, wherein the proximal end of the first support member is coupled with the proximal end of the mounting member and extends away from the first surface of the mounting member; and a second support member having a proximal end and a distal end, wherein the proximal end of the second support member is coupled to the first surface of the mounting member, wherein the distal end of the second support member consists of a cylindrical cavity having a proximal end and a distal end; a propeller shaft having a proximal end and a distal end, wherein the propeller shaft is coupled through the cylindrical cavity so that the distal end of the propeller shaft extends through and beyond the distal end of the cylindrical cavity and the proximal end of the propeller shaft extends through the first proximal aperture of the mounting member and is operatively coupled with an electric motor mounted on the first surface of the first support member through the aperture of the first support member, wherein the electric motor is operatively coupled to an electric power source; a propeller coupled to the distal end of the propeller shaft; a shaft log containing a shaft seal coupled to the first proximal aperture; a rudder having a proximal end, a distal end, and a rudder shaft extending perpendicular to a vertical plane of the rudder, wherein the rudder shaft is coupled through the second distal aperture of the mounting member, wherein the rudder shaft is operatively coupled to a helm; a rudder bearing tube coupled to the first surface of the mounting member; a coupling between the proximal end of the propeller shaft and an electric motor shaft extending from the electric motor; one or more bonding flanges each independently coupled to the first surface, a second surface, or a combination thereof of the mounting member; wherein the one or more bonding flanges are each independently coupled to the first surface of the mounting member; a first vertical flange and a second vertical flange each independently coupled to the first surface of the mounting member, wherein the first vertical flange, the second vertical flange, and the proximal end of the second support member are secured by one or more bolts; one or more vertical support members each independently coupled to the first surface, a second surface, or the first surface and the second surface of the mounting member; and wherein the one or more vertical support members are each independently coupled to the first surface of the mounting member.

BRIEF DESCRIPTION OF THE DRAWINGS

Embodiments of the invention may be best understood by referring to the following description and accompanying drawings, which illustrate such embodiments. In the drawings.

Figure 1:
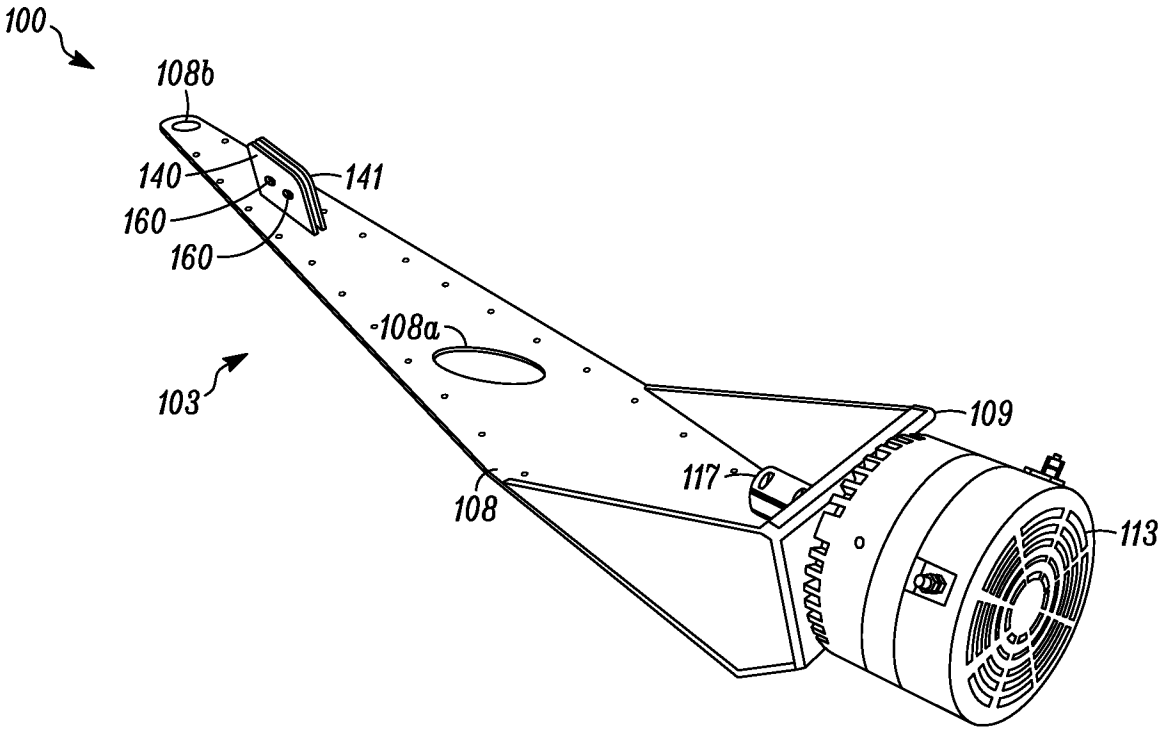
FIG. 1 is a perspective side view illustrating an exemplary electric-powered drive system for coupling to a hull of a watercraft.

The drawings are not necessarily to scale. Like numbers used in the figures refer to like components, steps, and the like. However, it will be understood that the use of a number to refer to a component in a given figure is not intended to limit the component in another figure labeled with the same number.

DETAILED DESCRIPTION OF THE INVENTION

The present invention provides an electric-powered drive system for coupling to a hull of a watercraft. The electric-powered drive system includes one or more mounting units; a first support members, a second support member, a propeller shaft, a propeller coupled to the distal end of the propeller shaft; and a rudder.

The following detailed description includes references to the accompanying drawings, which form a part of the detailed description. The drawings show, by way of illustration, specific embodiments in which the invention may be practiced. These embodiments, which are also referred to herein as "examples," are described in enough detail to enable those skilled in the art to practice the invention. The embodiments may be combined, other embodiments may be utilized, or structural, and logical changes may be made without departing from the scope of the present invention. The following detailed description is, therefore, not to be taken in a limiting sense, and the scope of the present invention is defined by the appended claims and their equivalents.

Before the present invention is described in such detail, however, it is to be understood that this invention is not limited to particular variations set forth and may, of course, vary. Various changes may be made to the invention described and equivalents may be substituted without departing from the true spirit and scope of the invention. In addition, many modifications may be made to adapt a particular situation, material, composition of matter, process, process act(s) or step(s), to the objective(s), spirit or scope of the present invention. All such modifications are intended to be within the scope of the claims made herein.

The referenced items are provided solely for their disclosure prior to the filing date of the present application. Nothing herein is to be construed as an admission that the present invention is not entitled to antedate such material by virtue of prior invention.

Unless otherwise indicated, the words and phrases presented in this document have their ordinary meanings to one of skill in the art. Such ordinary meanings can be obtained by reference to their use in the art and by reference to general and scientific dictionaries, for example, *Webster's Third New International Dictionary*, Merriam-Webster Inc., Springfield, Mass., 1993 and *The American Heritage Dictionary of the English Language*, Houghton Mifflin, Boston Mass., 1981.

References in the specification to "one embodiment" indicate that the embodiment described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to affect such feature, structure, or characteristic in connection with other embodiments whether or not explicitly described.

The following explanations of certain terms are meant to be illustrative rather than exhaustive. These terms have their ordinary meanings given by usage in the art and in addition include the following explanations.

As used herein, the term "and/or" refers to any one of the items, any combination of the items, or all of the items with which this term is associated.

As used herein, the singular forms "a," "an," and "the" include plural reference unless the context clearly dictates otherwise. It is further noted that the claims may be drafted to exclude any element. As such, this statement is intended to serve as antecedent basis for use of such exclusive terminology as "solely," "only," and the like in connection with the recitation of claim elements, or use of a "negative" limitation.

As used herein, the term "coupled" means the joining of two members directly or indirectly to one another. Such joining may be stationary in nature or movable in nature and/or such joining may allow for the flow of fluids, electricity, electrical signals, or other types of signals or communication between two members. Such joining may be achieved with the two members or the two members and any additional intermediate members being integrally formed as a single unitary body with one another or with the two members or the two members and any additional intermediate members being attached to one another. Such joining may be permanent in nature or alternatively may be removable or releasable in nature.

As used herein, the phrase "operatively coupled" refers to bringing two or more items together or into relationship with each other such that they may operate together or allow transfer of information between the two or more items.

As used herein, the terms "include," "for example," "such as," and the like are used illustratively and are not intended to limit the present invention.

As used herein, the terms "preferred" and "preferably" refer to embodiments of the invention that may afford certain benefits, under certain circumstances. However, other embodiments may also be preferred, under the same or other circumstances. Furthermore, the recitation of one or more preferred embodiments does not imply that other embodiments are not useful, and is not intended to exclude other embodiments from the scope of the invention.

As used herein, the term "watercraft" refers to a vessel for transport by water, constructed to provide buoyancy by excluding water and shaped to give stability and to allow propulsion. Also as used herein, the watercraft may include a molded hull and a molded deck.

As used herein, the terms "front," "back," "rear," "upper," "lower," "right," and "left" in this description are merely used to identify the various elements as they are oriented in the FIGS, with "front," "back," and "rear" being relative apparatus. These terms are not meant to limit the element which they describe, as the various elements may be oriented differently in various applications.

Figure 2:
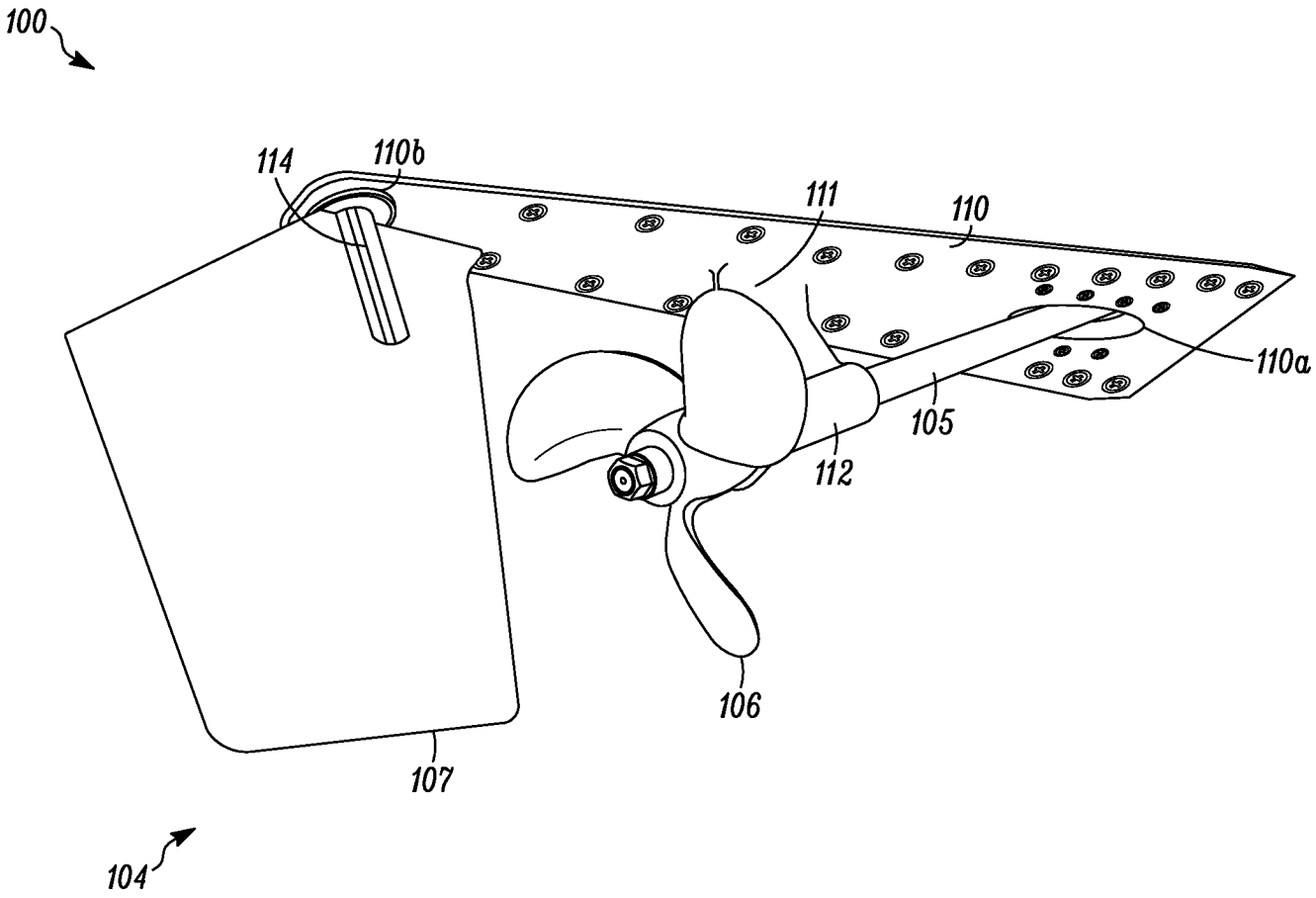
FIG. 2 is a perspective bottom view illustrating an exemplary electric-powered drive system for coupling to a hull of a watercraft.
Figure 3:
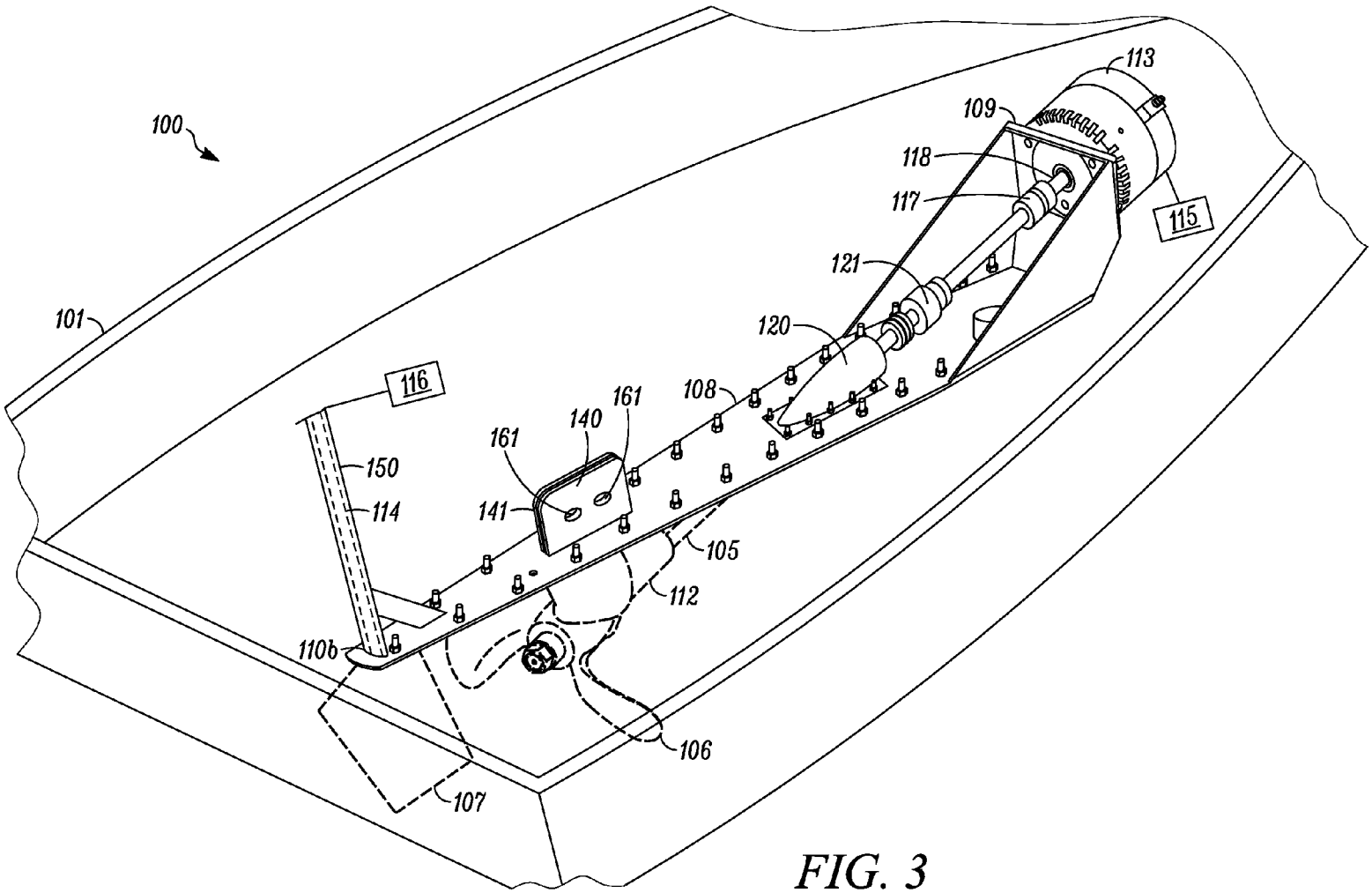
FIG. 3 is a perspective side view illustrating an exemplary electric-powered drive system for coupling to a hull of a watercraft.

FIGS. 1-3 are various views illustrating one or more components of an exemplary electric-powered drive system for coupling to a hull of a watercraft. The electric-powered drive system 100 coupled to a hull 101 of a watercraft 102. The electric-powered drive system 100 includes a first unit 103, a second unit 104, a propeller shaft 105, a propeller 106, and a rudder 107.

The hull 101 has an interior surface, an exterior surface, a first hull aperture (not shown), and a second hull aperture (not shown).

The first unit 103 includes a first mounting member 108 and a first support member 109. The first mounting member 108 has a first surface, a second surface, a proximal end, a distal end, a first proximal aperture 108*a*, and a second distal aperture 108*b*. The second surface of the first mounting member 108 is coupled to an interior surface of the hull 101. The first proximal aperture 108*a* is aligned with the first hull aperture 101*c* and the second distal aperture 108*b* is aligned with the second hull aperture 101*d*. The first support member 109 has a first surface, a second surface, a proximal end, a distal end, and an aperture 109*a*. The proximal end of the first support member 109 is coupled with the proximal end of the first mounting member 108 and extends away from the first surface of the first mounting member 108.

The second unit 104 includes a second mounting member 110 and a second support member 111. The second mounting member 110 has a first surface, a second surface, a proximal end, a distal end, a first proximal aperture 110*a* and a second distal aperture 110*b*. The first surface of the second mounting member 110 is coupled to an exterior surface of the hull 101 of the watercraft 102. The first proximal aperture 110*a* is aligned with the first hull aperture (not shown) and the second distal aperture 110*b* is aligned with the second hull aperture (not shown).

The second support member 111 has a proximal end and a distal end. The proximal end of the second support member 111 is coupled to the second surface of the second mounting member 110. The distal end of the second support member 111 includes a cylindrical cavity 112 having a proximal end and a distal end.

The propeller shaft 105 has a proximal end and a distal end. The propeller shaft 105 is coupled through the cylindrical cavity 112 so that the distal end of the propeller shaft extends through and beyond the distal end of the cylindrical cavity 112. The proximal end of the propeller shaft 105 extends through the first proximal aperture 110*a* of the second mounting member 110, the first hull aperture 101*c*, the first proximal aperture 108*a* of the first mounting member 108, and is operatively coupled with an electric motor 113 mounted on the first surface of the first support member 109 through the aperture 109*a* of the first support member 109.

The propeller 106 is coupled to the distal end of the propeller shaft 105.

The rudder 107 has a proximal end, a distal end, and a rudder shaft 114 extending perpendicular to a vertical plane of the rudder 107. The rudder shaft 114 is coupled through the second distal aperture 110*b* of the second mounting member 110, the second hull aperture 101*b*, and the second distal aperture 108*b* of the first mounting member 108 and inserted into the rudder bearing tube 150. The rudder bearing tube 150 should rise above the waterline and the rudder shaft 114 should rise above the rudder bearing tube 150 where it should be supported (lest it fall through the tube) by a collar, pin, or the like.

In one embodiment, the electric motor 113 is operatively coupled to an electric power source 115. In one embodiment, the rudder shaft 114 is operatively coupled to a helm 116.

In one embodiment, the electric-powered drive system 100 further includes a coupling 117 between the proximal end of the propeller shaft 105 and an electric motor shaft 118 extending from the electric motor 113.

In one embodiment, a shaft log 120 containing a shaft seal 121 (e.g., a Lasdrop Shaft-Seal, Nautical Specialties, Port Huron Township. Mich., 48060, USA) or a stuffing box (not shown) are placed in the first proximal aperture 110*a* and the second distal aperture 108*b* to prevent water from flowing into the hull 101.

In one embodiment, one or more bonding flanges (not shown) are coupled to the first surface, a second surface, or the first surface and the second surface of the first mounting member 108 and are used to couple the first unit 103 to the hull 101.

In one embodiment, one or more bonding flanges (not shown) are coupled to the first surface, a second surface, or the first surface and the second surface of the second mounting member 110 and are used to couple the second unit 104 to the hull 101.

In one embodiment, a first vertical flange 140 and a second vertical flange 141 are coupled to the first mounting member 108 that contains a slit (not shown) that accepts the proximal end of the second support member 111. In one embodiment, the first vertical flange 140 and the second vertical flange 141 include bolt holes 160. In one embodiment, bolts 161 secure the first vertical flange 140 and the second vertical flange 141 to the proximal end of the second support member 111.

To attach the electric-powered drive system 100 to the hull 101, the following procedure is performed. The electric-powered drive system 100 is bench-aligned and disassembled. The second mounting member 110 is placed on the bottom of the hull 101 in the desired location. The holes (not shown) for the mounting bolts are drilled by using the second mounting member 110 as a template. The slit (not shown) for the second support member 111 is marked and cut, as is the first hull aperture (not shown) and a second hull aperture (not shown) for the propeller shaft 105 and rudder shaft 114. Sealant is applied around all holes and the second mounting member 110 is put in place. The first unit 103 is put into place and the bolts and nuts are installed from the outside, through the second mounting member 110, through the hull 101 and through the first unit 103. The nuts (not shown) are installed from the inside and tightened. The excess sealant that has squeezed out after tightening is removed. The second support member 111 is installed up though the hull 101 from the outside by siding it up through the slit in the hull 101 and into position between the first vertical flange 140 and a second vertical flange 141 in the first unit 103 and bolted into place with bolts 161. This ability to slide the second mounting member 110 into place and micro-adjust it before bolting is a novel and useful element of the invention. Sealant is applied around the base of the second support member 111 where it goes through the slit (not shown) in the hull 101. The propeller shaft 105 is installed by sliding it up from the outside though the shaft bearing (not shown), through the shaft log 120 and into position. The shaft seal 121 is slid down the propeller shaft 105 from the inside and coupled to the shaft log 120 with hose clamps (not shown). The corresponding seal (not shown) is attached to the propeller shaft 105. The coupling 117 is installed on the inside end of the propeller shaft 105. The electric motor 113 is installed by sliding the electric motor shaft 118 into the coupling 117. The electric motor 113 is bolted into place and operatively coupled to the power source 115. The coupling 117 is tightened. The rudder 107 is installed from the outside of the hull 101 by siding it up through the second mounting member 110, through the hull 101 and into the rudder shaft 114. The steering arm (not shown) is mounted to the top of the rudder 107 to hold it in place and operatively connected to the helm 116.

Figure 4:
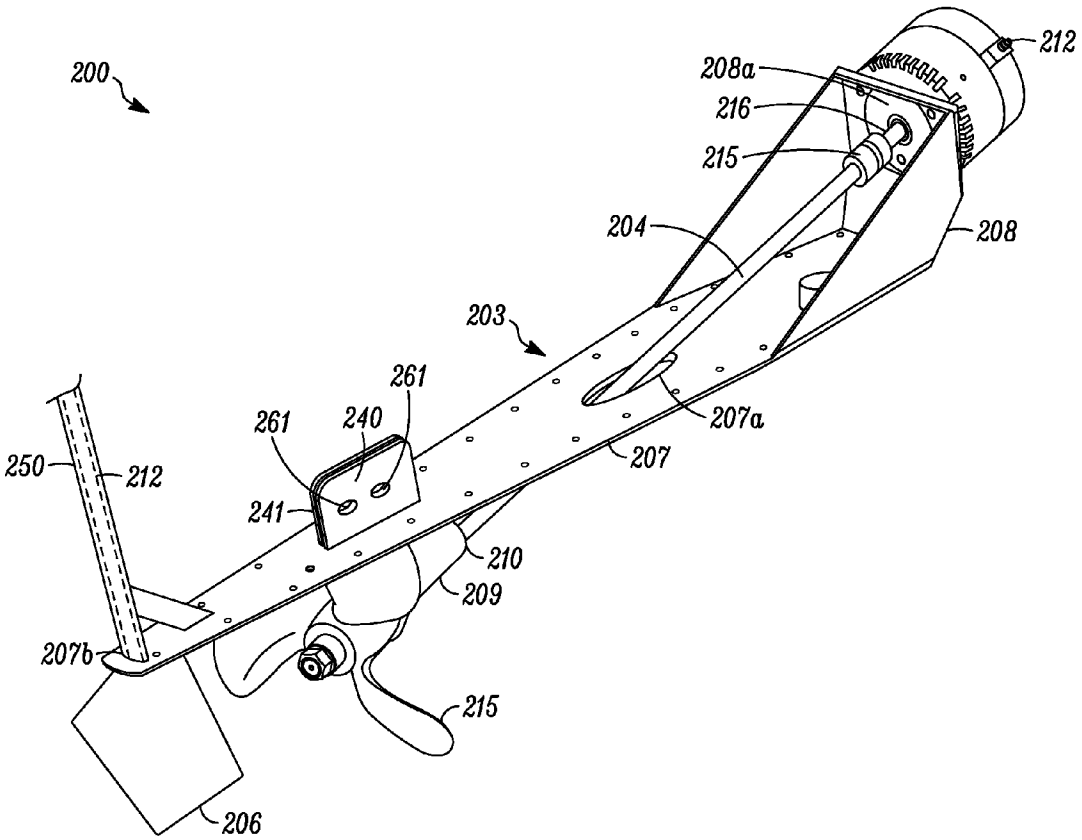
FIG. 4 is a perspective side view illustrating an exemplary electric-powered drive system for coupling to a hull of a watercraft.
Figure 5:
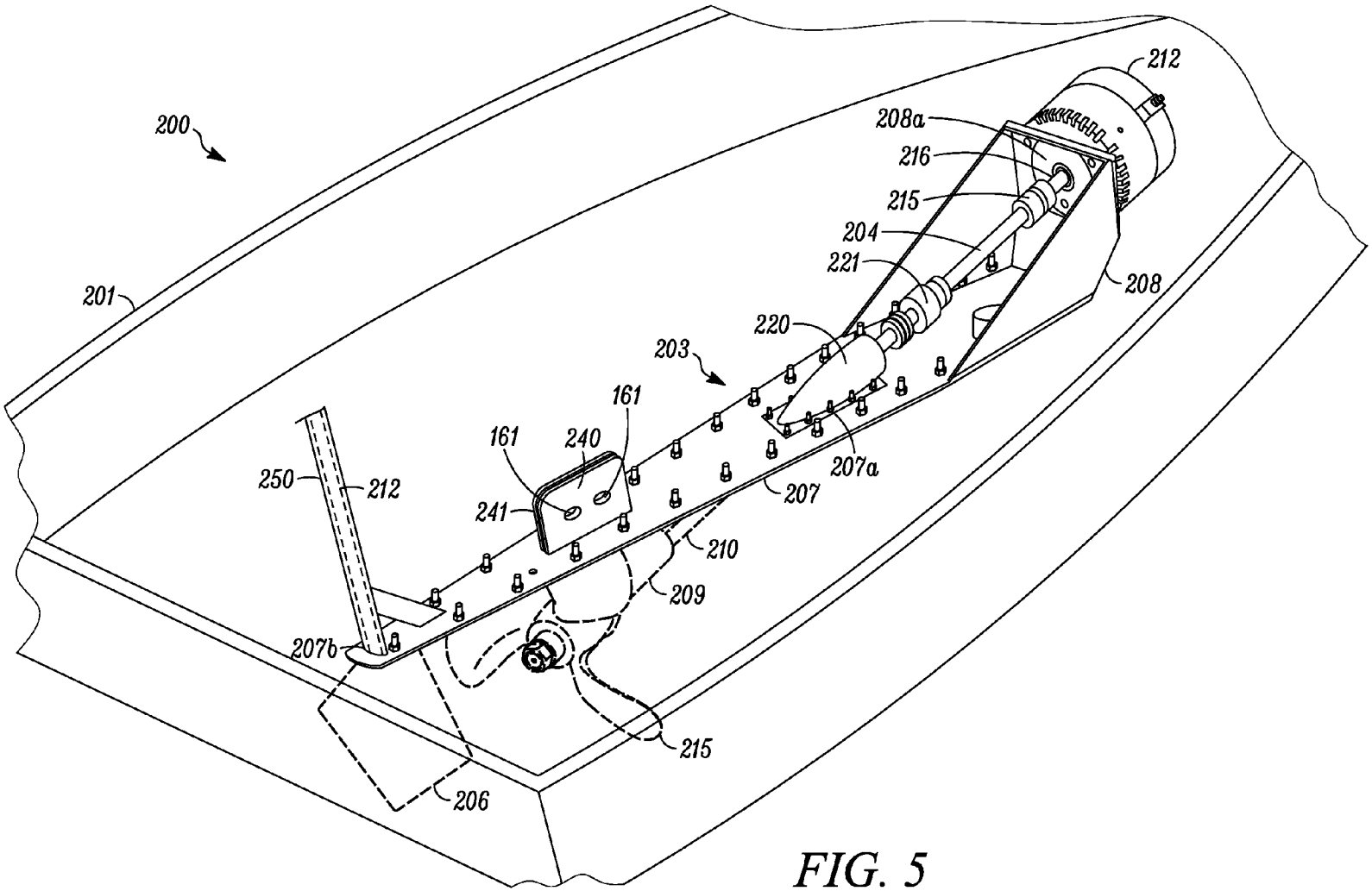
FIG. 5 is a perspective side view illustrating an exemplary electric-powered drive system for coupling to a hull of a watercraft.

FIGS. 4-5 are various views illustrating one or more components of an exemplary electric-powered drive system for coupling to a hull of a watercraft. The electric-powered drive system 200 is coupled to a hull 201 of a watercraft 202. The electric-powered drive system 200 includes a unit 203, a propeller shaft 204, a propeller 205, and a rudder 206. The hull 201 has an interior surface, an exterior surface, and an aperture on the bottom of the hull (201) of the watercraft (202).

The unit 203 includes a mounting member 207, a first support member 208, and a second support member 209. The mounting member 207 has a first surface, a second surface, a proximal end, a distal end, a first proximal aperture 207*a*, and a second distal aperture 207*b*. The mounting member 207 the mounting member is coupled to the opening (not shown) on the bottom of the hull 201 of the watercraft 202. The first support member 208 has a first surface, a second surface, a proximal end, a distal end, and an aperture 208*a*. The proximal end of the first support member 208 is coupled with the proximal end of the first surface of the mounting member 207 and extends away from the first surface of the mounting member 207.

The second support member 209 has a proximal end and a distal end. The proximal end of the second support member 209 is coupled to the second surface of the mounting member 207. The distal end of the second support member 209 includes a cylindrical cavity 210 having a proximal end and a distal end.

The propeller shaft 204 has a proximal end and a distal end. The propeller shaft 204 is coupled through the cylindrical cavity 210 so that the distal end of the propeller shaft extends through and beyond the distal end of the cylindrical cavity 210. The proximal end of the propeller shaft 204 extends through the first proximal aperture 207*a* of the mounting member 207 and is operatively coupled with an electric motor 211 mounted on the first surface of the first support member 208 through the aperture 208*e* of the first support member 208.

The propeller 205 is coupled to the distal end of the propeller shaft 204.

The rudder 206 has a proximal end, a distal end, and a rudder shaft 212 extending perpendicular to a vertical plane of the rudder 206. The rudder shaft 212 is coupled through the second distal aperture 207*b* of the mounting member 207 and inserted into the rudder bearing tube 250. The rudder bearing tube 250 should rise above the waterline and the rudder shaft 212 should rise above the rudder bearing tube 250 where it should be supported (lest it fall through the tube) by a collar, pin, or the like.

In one embodiment, the electric motor 211 is operatively coupled to an electric power source 213. In one embodiment, the rudder shaft 212 is operatively coupled to a helm 214.

In one embodiment, the electric-powered drive system 200 further includes a coupling 215 between the proximal end of the propeller shaft 204 and an electric motor shaft 216 extending from the electric motor 211.

In one embodiment, one or more aperture couplings (not shown) are placed in the first proximal aperture 207*a* and the second distal aperture 207*b* to prevent water from flowing into the hull 201.

In one embodiment, a shaft log 220 containing a shaft seal 221 (e.g., a Lasdrop Shaft-Seal, Nautical Specialties, Port Huron Township. Mich., 48060, USA) or a stuffing box (not shown) are placed in the first proximal aperture 207*a* and the second distal aperture 207*b* to prevent water from flowing into the hull 201.

In one embodiment, a first vertical flange 240 and a second vertical flange 241 are coupled to the mounting member 207 that contains a slit (not shown) that accepts the proximal end of the second support member 209.

In one embodiment, bolts 261 secure the first vertical flange 240 and the second vertical flange 241 to the proximal end of the second support member 209.

Figure 6:
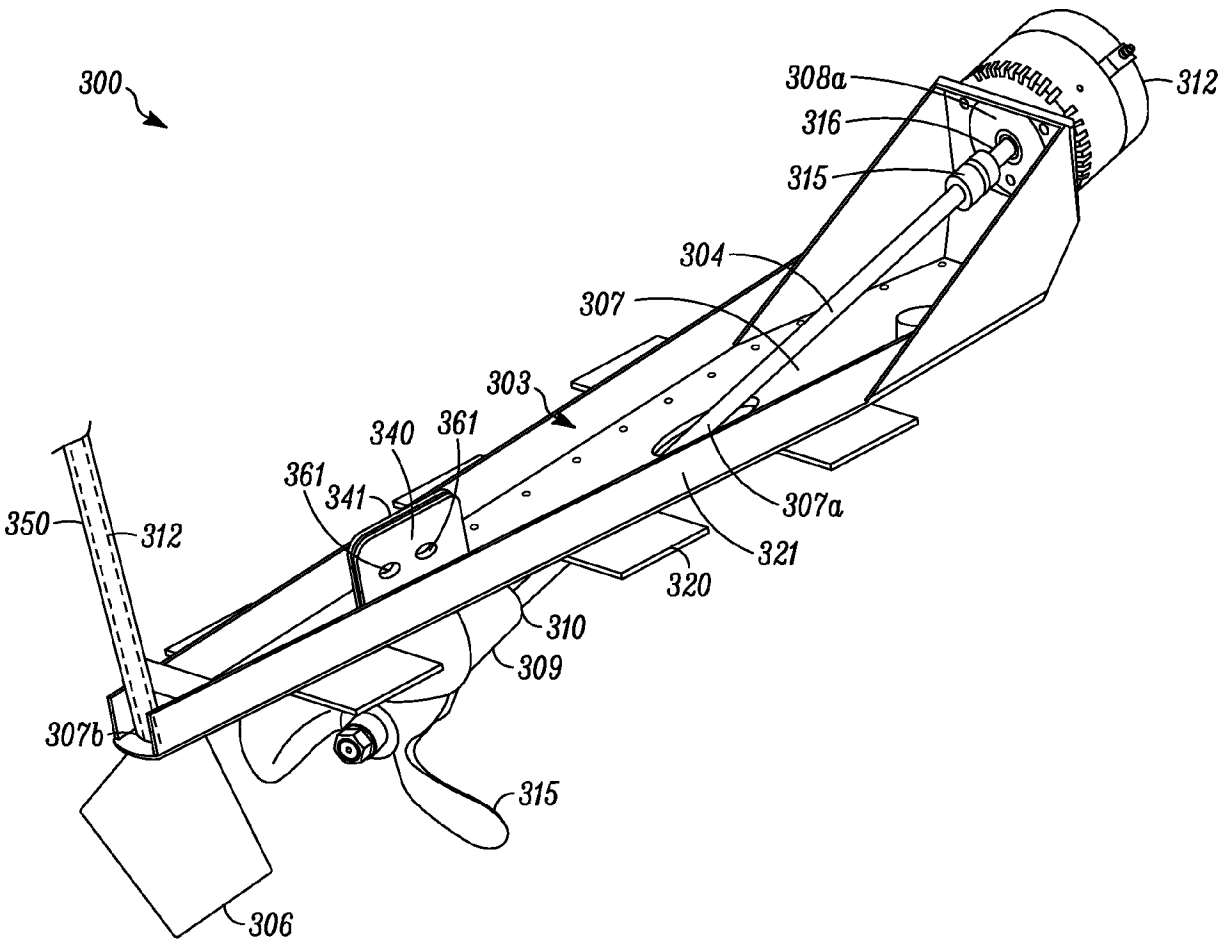
FIG. 6 is a perspective side view illustrating an exemplary electric-powered drive system for coupling to a hull of a watercraft.

FIG. 6 is a perspective side view illustrating an exemplary electric-powered drive system for coupling to a hull of a watercraft. The electric-powered drive system 300 is coupled to a hull 301 of a watercraft 302. The electric-powered drive system 300 includes a unit 303, a propeller shaft 304, a propeller 305, and a rudder 306. The hull 301 has an interior surface, an exterior surface, and an aperture on the bottom of the hull 301 of the watercraft (302).

The unit 303 includes a mounting member 307, a first support member 308, and a second support member 309. The mounting member 307 has a first surface, a second surface, a proximal end, a distal end, a first proximal aperture 307*a*, and a second distal aperture 307*b*. The mounting member 307 the mounting member is coupled to the opening (not shown) on the bottom of the hull (301) of the watercraft (302). The first support member 308 has a first surface, a second surface, a proximal end, a distal end, and an aperture 308*a*. The proximal end of the first support member 308 is coupled with the proximal end of the first surface of the mounting member 307 and extends away from the first surface of the mounting member 307.

The second support member 309 has a proximal end and a distal end. The proximal end of the second support member 309 is coupled to the second surface of the mounting member 307. The distal end of the second support member 309 includes a cylindrical cavity 310 having a proximal end and a distal end.

The propeller shaft 304 has a proximal end and a distal end. The propeller shaft 304 is coupled through the cylindrical cavity 310 so that the distal end of the propeller shaft extends through and beyond the distal end of the cylindrical cavity 310. The proximal end of the propeller shaft 304 extends through the first proximal aperture 307*a* of the mounting member 307 and is operatively coupled with an electric motor 311 mounted on the first surface of the first support member 308 through the aperture 308*e* of the first support member 308.

The propeller 305 is coupled to the distal end of the propeller shaft 304.

The rudder 306 has a proximal end, a distal end, and a rudder shaft 312 extending perpendicular to a vertical plane of the rudder 306. The rudder shaft 312 is coupled through the second distal aperture 307*b* of the mounting member 307 and inserted into the rudder bearing tube 350. The rudder bearing tube 350 should rise above the waterline and the rudder shaft 312 should rise above the rudder bearing tube 350 where it should be supported (lest it fall through the tube) by a collar, pin, or the like.

In one embodiment, the electric motor 311 is operatively coupled to an electric power source 313. In one embodiment, the rudder shaft 312 is operatively coupled to a helm 314.

In one embodiment, the electric-powered drive system 300 further includes a coupling 315 between the proximal end of the propeller shaft 304 and an electric motor shaft 316 extending from the electric motor 311.

In one embodiment, one or more aperture couplings (not shown) are placed in the first proximal aperture 307*a* and the second distal aperture 307*b* to prevent water from flowing into the hull 301.

In one embodiment, one or more bonding flanges 320 are coupled to the first surface, a second surface, or the first surface and the second surface of the mounting member 307 and are used to couple the unit 303 to the hull 301.

In one embodiment, one or more vertical support members 321 are coupled to the first surface, a second surface, or the first surface and the second surface of the mounting member 307.

In one embodiment, one or more bonding flanges 320 would lay against the hull 301. The one or more bonding flanges 320 may be bonded with a bonding agent such as epoxy. This would be the bond between the electric-powered drive system 300, the one or more bonding flanges 320, and the hull 301. At the same time, composite material such as fiberglass/epoxy or fiberglass/polyester (not shown) may be laminated over the top of the one or more bonding flanges 320 and extending beyond the one or more bonding flanges 320 onto the hull 301 of the watercraft 302 to form a chemical and mechanical bond.

In one embodiment, a first vertical flange 340 and a second vertical flange 341 are coupled to the mounting member 307 that contains a slit (not shown) that accepts the proximal end of the second support member 309. In one embodiment, bolts 361 secure the first vertical flange 340 and the second vertical flange 341 to the proximal end of the second support member 309.

It will be understood that, although the terms first, second, etc. may be used herein to describe various elements, these elements should not be limited by these terms. These terms are only used to distinguish one element from another. For example, a first element could be termed a second element, and, similarly, a second element could be termed a first element without departing from the teachings of the disclosure.

Except as explicitly required by claim language, a single substance or component may meet more than a single functional requirement, provided that the single substance fulfills the more than one functional requirement as specified by claim language.

All patents, patent applications, publications, scientific articles, web sites, and other documents and materials referenced or mentioned herein are indicative of the levels of skill of those skilled in the art to which the invention pertains, and each such referenced document and material is hereby incorporated by reference to the same extent as if it had been incorporated by reference in its entirety individually or set forth herein in its entirety. Additionally, all claims in this application, and all priority applications, including but not limited to original claims, are hereby incorporated in their entirety into, and form a part of, the written description of the invention.

Applicants reserve the right to physically incorporate into this specification any and all materials and information from any such patents, applications, publications, scientific articles, web sites, electronically available information, and other referenced materials or documents. Applicants reserve the right to physically incorporate into any part of this document, including any part of the written description, the claims referred to above including but not limited to any original claims.

What is claimed is:

1. A electric-powered drive system for coupling to a hull of a watercraft comprising:

a first unit comprising:

a first mounting member having a first surface, a second surface, a proximal end, a distal end, a first proximal aperture, and a second distal aperture;

a first support member having a first surface, a second surface, a proximal end, a distal end, and an aperture, wherein the proximal end of the first support member is coupled with the proximal end of the first mounting member and extends away from the first surface of the first mounting member;

a second unit comprising:

a second mounting member having a first surface, a second surface, a proximal end, a distal end, a first proximal aperture, and a second distal aperture;

a second support member having a proximal end and a distal end, wherein the proximal end of the second support member is coupled to the second surface of the second mounting member, wherein the distal end of the second support member comprises a cylindrical cavity having a proximal end and a distal end;

a propeller shaft having a proximal end and a distal end, wherein the propeller shaft is coupled through the cylindrical cavity so that the distal end of the propeller shaft extends through and beyond the distal end of the cylindrical cavity and the proximal end of the propeller shaft extends through the first proximal aperture of the second mounting member, the first proximal aperture of the first mounting member, and is operatively coupled with an electric motor mounted on the first surface of the first support member through the aperture of the first support member;

a propeller coupled to the distal end of the propeller shaft; and a rudder having a proximal end, a distal end, and a rudder shaft extending perpendicular to a vertical plane of the rudder, wherein the rudder shaft is coupled through the second distal aperture of the second mounting member and the second distal aperture of the first mounting member.

2. The electric-powered drive system of claim 1, wherein the electric motor is operatively coupled to an electric power source.

3. The electric-powered drive system of claim 1, further comprising a rudder bearing tube coupled to the first surface of the first mounting member.

4. The electric-powered drive system of claim 1, wherein the rudder shaft is operatively coupled to a helm.

5. The electric-powered drive system of claim 1, further comprising a coupling between the proximal end of the propeller shaft and an electric motor shaft extending from the electric motor.

6. The electric-powered drive system of claim 1, further comprising a shaft log containing a shaft seal coupled to the first proximal aperture and the second distal aperture.

7. The electric-powered drive system of claim 1, further comprising a first vertical flange and a second vertical flange each independently coupled to the first surface of the first mounting member.

8. The electric-powered drive system of claim 7, further comprising one or more bolts to secure the first vertical flange and the second vertical flange to the proximal end of the second support member.

9. A electric-powered drive system for coupling to a hull of a watercraft comprising:

a first unit comprising:

a first mounting member having a first surface, a second surface, a proximal end, a distal end, a first proximal aperture, and a second distal aperture;

a first support member having a first surface, a second surface, a proximal end, a distal end, and an aperture, wherein the proximal end of the first support member is coupled with the proximal end of the first mounting member and extends away from the first surface of the first mounting member;

a second unit comprising:

a second mounting member having a first surface, a second surface, a proximal end, a distal end, a first proximal aperture, and a second distal aperture;

a second support member having a proximal end and a distal end, wherein the proximal end of the second support member is coupled to the second surface of the second mounting member, wherein the distal end of the second support member comprises a cylindrical cavity having a proximal end and a distal end;

a propeller shaft having a proximal end and a distal end, wherein the propeller shaft is coupled through the cylindrical cavity so that the distal end of the propeller shaft extends through and beyond the distal end of the cylindrical cavity and the proximal end of the propeller shaft extends through the first proximal aperture of the second mounting member, the first proximal aperture of the first mounting member, and is operatively coupled with an electric motor mounted on the first surface of the first support member through the aperture of the first support member, wherein the electric motor is operatively coupled to an electric power source;

a propeller coupled to the distal end of the propeller shaft;

a rudder having a proximal end, a distal end, and a rudder shaft extending perpendicular to a vertical plane of the rudder, wherein the rudder shaft is coupled through the second distal aperture of the second mounting member and the second distal aperture of the first mounting member, wherein the rudder shaft is operatively coupled to a helm;

a first vertical flange and a second vertical flange each independently coupled to the first surface of the first mounting member;

a shaft log containing a shaft seal coupled to the first proximal aperture and the second distal aperture: and a coupling between the proximal end of the propeller shaft and an electric motor shaft extending from the electric motor.

10. The electric-powered drive system of claim 9, further comprising a rudder bearing tube coupled to the first surface of the first mounting member and one or more bolts to secure the first vertical flange and the second vertical flange to the proximal end of the second support member.

11. A electric-powered drive system for coupling to a hull of a watercraft comprising:

a unit comprising:

a mounting member having a first surface, a second surface, a proximal end, a distal end, a first proximal aperture, and a second distal aperture, wherein the mounting member is coupled to an opening on a bottom of the hull of the watercraft;

a first support member having a first surface, a second surface, a proximal end, a distal end, and an aperture, wherein the proximal end of the first support member is coupled with the proximal end of the mounting member and extends away from the first surface of the mounting member; and a second support member having a proximal end and a distal end, wherein the proximal end of the second support member is coupled to the first surface of the mounting member, wherein the distal end of the second support member comprises a cylindrical cavity having a proximal end and a distal end;

a propeller shaft having a proximal end and a distal end, wherein the propeller shaft is coupled through the cylindrical cavity so that the distal end of the propeller shaft extends through and beyond the distal end of the cylindrical cavity and the proximal end of the propeller shaft extends through the first proximal aperture of the mounting member and is operatively coupled with an electric motor mounted on the first surface of the first support member through the aperture of the first support member;

a propeller coupled to the distal end of the propeller shaft; and a rudder having a proximal end, a distal end, and a rudder shaft extending perpendicular to a vertical plane of the rudder, wherein the rudder shaft is coupled through the second distal aperture of the mounting member.

12. The electric-powered drive system of claim 11, wherein the electric motor is operatively coupled to an electric power source.

13. The electric-powered drive system of claim 11, further comprising a rudder bearing tube coupled to the first surface of the mounting member.

14. The electric-powered drive system of claim 11, wherein the rudder shaft is operatively coupled to a helm.

15. The electric-powered drive system of claim 11, further comprising a shaft log containing a shaft seal coupled to the first proximal aperture.

16. The electric-powered drive system of claim 11, further comprising a coupling between the proximal end of the propeller shaft and an electric motor shaft extending from the electric motor.

17. The electric-powered drive system of claim 11, further comprising one or more bonding flanges each independently coupled to the first surface, a second surface, or a combination thereof of the mounting member.

18. The electric-powered drive system of claim 17, wherein the one or more bonding flanges are each independently coupled to the first surface of the mounting member.

19. The electric-powered drive system of claim 11, further comprising one or more vertical support members each independently coupled to the first surface, a second surface, or the first surface and the second surface of the mounting member, wherein the first vertical flange, the second vertical flange, and the proximal end of the second support member are secured by one or more bolts.

20. The electric-powered drive system of claim 11, further comprising a first vertical flange and a second vertical flange each independently coupled to the first surface of the mounting member.

* * * * *